US006484382B1

(12) United States Patent
Smith

(10) Patent No.: US 6,484,382 B1
(45) Date of Patent: Nov. 26, 2002

(54) METHOD OF PROVIDING AN INTERNAL CIRCUMFERENTIAL SHOULDER IN A CYLINDRICAL PASSAGEWAY

(75) Inventor: Jerry D. Smith, The Woodlands, TX (US)

(73) Assignee: ERC Industries, Inc., Houston, TX (US)

( * ) Notice: Subject to any disclaimer, the term of this patent is extended or adjusted under 35 U.S.C. 154(b) by 78 days.

(21) Appl. No.: 09/653,132

(22) Filed: Aug. 31, 2000

Related U.S. Application Data

(60) Provisional application No. 60/191,701, filed on Mar. 23, 2000.

(51) Int. Cl.[7] ..... B23P 9/00

(52) U.S. Cl. ..... 29/445; 29/558; 29/416; 285/3

(58) Field of Search ..... 29/558, 463, 466, 29/469, 890.124, 890.125, 412, 411, 416, 425, 464, 445; 166/208, 368, 206, 214; 285/3, 18, 141

(56) References Cited

U.S. PATENT DOCUMENTS

| | | | | | |
|---|---|---|---|---|---|
| 639,722 | A | * | 12/1899 | France | 28/888.076 |
| 865,998 | A | * | 9/1907 | Cook | 277/546 |
| 2,086,431 | A | | 7/1937 | Penick et al. | 285/22 |
| 2,328,840 | A | | 9/1943 | O'Leary | 166/1 |
| 3,224,080 | A | * | 12/1965 | Bryant et al. | 29/890.125 |
| 3,341,227 | A | | 9/1967 | Pierce, Jr. | 285/39 |
| 3,836,158 | A | * | 9/1974 | Davidson et al. | 277/146 |
| 3,893,717 | A | * | 7/1975 | Nelson | 285/3 |
| 3,918,747 | A | | 11/1975 | Puth | 285/4 |
| 3,971,119 | A | * | 7/1976 | Walker | 29/416 |
| 4,167,970 | A | * | 9/1979 | Cowan | 166/208 |
| 4,319,773 | A | * | 3/1982 | Lawson | 285/123.2 |
| 4,515,400 | A | | 5/1985 | Smith et al. | 285/141 |
| 4,528,738 | A | * | 7/1985 | Galle | 29/416 |
| 4,534,583 | A | | 8/1985 | Milberger et al. | 285/24 |
| 4,550,782 | A | | 11/1985 | Lawson | 166/382 |
| 4,577,686 | A | * | 3/1986 | Milberger et al. | 166/208 |
| 4,580,793 | A | * | 4/1986 | Bronson | 29/516 |
| 4,641,708 | A | | 2/1987 | Wightman | 166/208 |
| 4,651,830 | A | | 3/1987 | Crotwell | 166/338 |
| 4,669,165 | A | * | 6/1987 | Maghon | 29/416 |
| 4,681,166 | A | * | 7/1987 | Cuiper | 166/345 |
| 4,730,851 | A | * | 3/1988 | Watts | 285/4 |
| 4,751,968 | A | | 6/1988 | Ames et al. | 166/368 |
| 4,770,249 | A | | 9/1988 | Courtney | 166/379 |
| 4,903,992 | A | | 2/1990 | Jennings et al. | 285/24 |
| 5,026,097 | A | | 6/1991 | Reimert | 285/141 |
| 5,060,985 | A | | 10/1991 | Seaton | 285/141 |
| 5,209,521 | A | | 5/1993 | Osborne | 285/3 |
| 5,259,459 | A | | 11/1993 | Valka | 166/345 |
| 5,327,965 | A | | 7/1994 | Stephen et al. | 166/208 |
| 5,984,008 | A | * | 11/1999 | Lang et al. | 166/208 |

* cited by examiner

*Primary Examiner*—Gregory M. Vidovich
*Assistant Examiner*—Marc Jimenez
(74) *Attorney, Agent, or Firm*—Head, Johnson & Kachigian

(57) ABSTRACT

A method of providing an internal circumferential shoulder in a cylindrical passageway including the steps of forming an enlarged internal diameter groove in the passageway, machining an integral unitary circumferential shoulder blank of external dimensions conforming to the groove, cutting the shoulder blank into at least segments, each segment having opposed end surfaces that match the end surfaces of adjacent segments, the opposed end surfaces of one segment being defined by parallel, spaced-apart planes forming a key segment, positioning the shoulder segments into the groove, the key segment being inserted last and securing the key segment within the groove.

13 Claims, 2 Drawing Sheets

FIG. 2
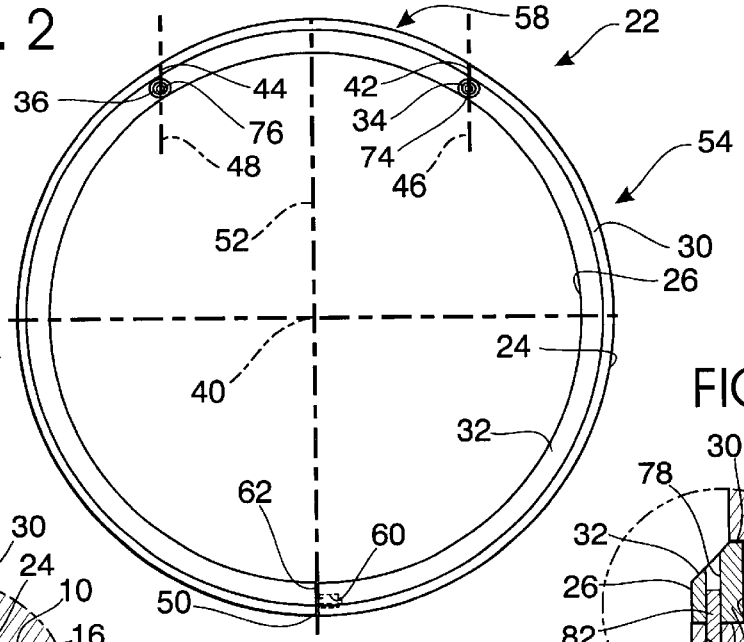
FIG. 6
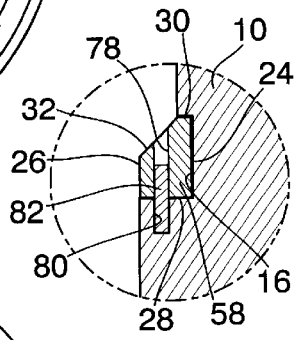
FIG. 7
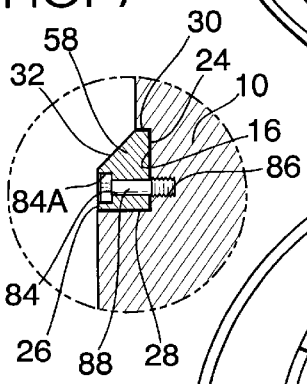
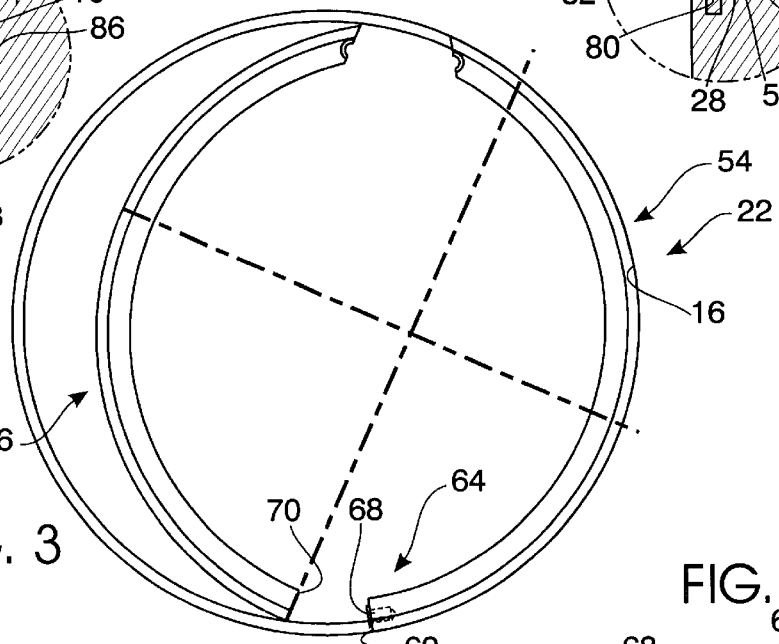
FIG. 3
FIG. 5
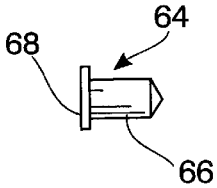
FIG. 4
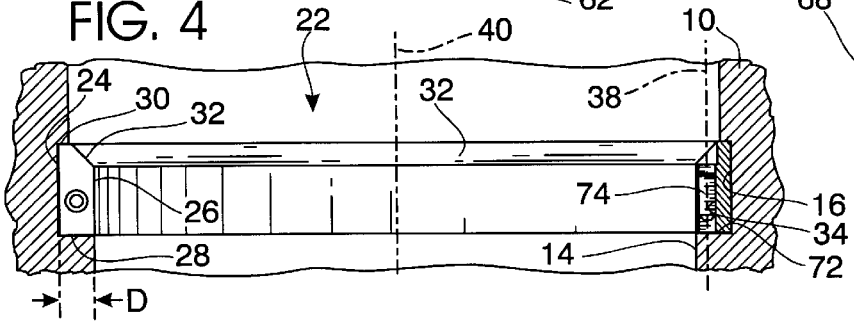

METHOD OF PROVIDING AN INTERNAL CIRCUMFERENTIAL SHOULDER IN A CYLINDRICAL PASSAGEWAY

REFERENCE TO PENDING APPLICATIONS

This application is related to and obtains the priority date of Provisional Patent Application Ser. No. 60/191,701 filed Mar. 23, 2000. entitled, "SEGMENTED LOAD SHOULDER FOR TUBING OR CASING HANGER".

REFERENCE TO MICROFICHE APPENDIX

This application is not referenced in any Microfiche Appendix.

BACKGROUND OF THE INVENTION

This invention is concerned with a method of providing an internal circumferential shoulder in a cylindrical passageway and is exemplified by an installable load shoulder for a tubing or casing head, that is also frequently called a "wellhead". "Tubing" or "casing" as used herein is inclusive of tubular products as used in drilling and completing oil and/or gas wells. The invention is particularly concerned with, but not limited to, an installable load shoulder positioned in a wellhead to support a tubing hanger or a casing hanger.

When a well is drilled into the earth it is customary to attach at the upper end of the well, such as at the upper end of surface casing, a wellhead which provides the superstructure for supporting smaller diameter tubular strings, whether strings of casing or strings of tubing. For this purpose a hanger is employed, either a casing hanger or a tubing hanger as the case may be that is secured to the upper end of a string of pipe—that is, a string of casing or a string of tubing. Within the wellhead means must be provided for removably supporting the hanger and for this purpose it is customary to provide in the wellhead a circumferential load shoulder. A removable hanger, having casing or tubing suspended therefrom, is rested on the load shoulder. One problem with this arrangement is that the provision of an internally extending circumferential ledge within the interior of a wellhead reduces the internal diameter of the wellhead and thereby limits the diameter of drill bits or other tools or implements that may thereafter be inserted through the wellhead. The invention herein is an installable load shoulder that provides means for supporting a hanger, either a tubing hanger or a casing hanger within the wellhead and in a manner that the internal diameter of the wellhead is maximized. That is, a wellhead, having a full internal diameter opening therethrough can be equipped with a load shoulder that provides an inwardly protruding circumferential ledge on which a tubing or casing hanger can be supported and the installable load shoulder makes it possible to maintain a larger wellhead minimum internal diameter.

The concept of utilizing an installable load shoulder in a wellhead to support a tubing or a casing hanger is illustrated and described in U.S. Pat. No. 5,984,008 that issued on Nov. 16, 1999, entitled: "INSTALLABLE LOAD SHOULDER FOR USE IN A WELLHEAD TO SUPPORT A TUBING HANGER". U.S. Pat. No. 5,984,008 is incorporated herein by reference and is a source of background information to the type of invention to which the present disclosure pertains. For further background information reference can be had to the following previously issued U.S. Patents:

| PATENT NO. | INVENTOR | TITLE |
|---|---|---|
| 2,086,431 | Penick et al. | Tubing Head |
| 2,328,840 | O'Leary | Linear Hanger |
| 3,341,227 | Pierce, Jr. | Casing Hanger |
| 3,893,717 | Nelson | Well Casing Hanger Assembly |
| 3,918,747 | Putch | Well Suspension System |
| 4,167,970 | Cowan | Hanger Apparatus for Suspending Pipes |
| 4,515,400 | Smith et al. | Wellhead Assembly |
| 4,528,738 | Galle, Jr. | Dual Ring Casing Hanger |
| 4,534,583 | Milberger et al. | Mudline Casing Hanger Assembly |
| 4,550,782 | Lawson | Method and Apparatus for Independent Support of Well Pipe Hangers |
| 4,641,708 | Wightman | Casing Hanger Locking Device |
| 4,651,830 | Crotwell | Marine Wellhead Structure |
| 4,751,968 | Ames et al. | Wellhead Stabilizing Member with Deflecting Ribs |
| 4,770,249 | Courtney | Method and Apparatus for Reduction of Well Assembly Time |
| 4,903,992 | Jennings et al. | Locking Ring for Oilwell Tool |
| 5,026,097 | Reimert | Wellhead Apparatus |
| 5,060,985 | Seaton | Location of Tubular Members |
| 5,209,521 | Osburne | Expanding Load Shoulder |
| 5,259,459 | Valka | Subsea Wellhead Tieback Connector |
| 5,327,965 | Stephen et al. | Wellhead Completion System |
| 5,984,008 | Lang et al. | Installable Load Shoulder for Use in a Wellhead to Support a Tubing Hanger |

BRIEF DESCRIPTION OF THE INVENTION

This invention is a method of providing an internal circumferential shoulder in a cylindrical passageway and will be described and illustrated as the invention is employed to provide a wellhead installable load shoulder.

A wellhead is a metallic device affixed to the upper end of surface casing of an oil or gas well that is employed to suspend casing and/or tubing in the well. More specifically, a wellhead functions to provide the super-structure for suspending the upper end of a string of casing or tubing that extends from the earth's surface down into a bore hole. In addition to providing the structures to support the weight of strings of tubing or casing, a wellhead functions to close off the upper end portion of casing or tubing and to provide communication as necessary with equipment whereby oil or gas produced by the well can be safely conveyed for refining and/or use without leakage to the environment.

Wellheads provide a vertical opening down which strings of tubing or casing or tools, such as drill bits can be inserted. The most typical construction of a wellhead employs the arrangement wherein the vertical cylindrical opening has two internal diameters—that is, a lower reduced internal diameter and an upper enlarged internal diameter, the differences in diameters providing an integral, circumferential ledge or shoulder that is used to support a tubing or casing hanger. The maximum diameter of any device passing through the typical wellhead is limited to the smaller diameter lower portion of the wellhead vertical opening that defines the load shoulder. One way of providing a larger diameter passageway is to make the load shoulder a separate element. In this way an internal circumferential groove is provided in the opening through the wellhead and a load shoulder can then be inserted into the groove to support a casing or tubing hanger when required. An example of an installable load shoulder for use in a wellhead is U.S. Pat. No. 5,984,008 entitled, "INSTALLABLE LOAD SHOULDER FOR USE IN A WELLHEAD TO SUPPORT A TUBING HANGER". As previously stated, this patent is incorporated herein by reference. In this patent, a wellhead is provided with an internal circumferential groove and an integral toroidal member functions as an installable load shoulder. The integral toroidal member has a split therein that defines opposed first and second ends. The integral toroidal load shoulder can be collapsed so that the ends move toward each other providing an external diameter that is less than the internal diameter of the opening through the wellhead. When the circumferentially collapsed toroidal member is moved downwardly within the opening through the wellhead to the location of the enlarged internal diameter circumferential groove, the toroidal member can then resiliently expand to an increased external diameter within the circumferential groove. The end surfaces moving apart from each other so that the integral toroidal member is thereby seated within the circumferential groove. The toroidal member is configured so that when seated it extends circumferentially within the borehole opening and thereby provides a circumferential surface on which a tubing or casing hanger can be seated.

The present invention provides a load shoulder that accomplishes the same basic function as the installable load shoulder of U.S. Pat. No. 5,984,008 but has a completely different structural arrangement and is installed in the interior of a wellhead in a completely different way.

The present invention includes a toroidal member manufactured to have a predetermined radial cross-sectional configuration dimensioned to fit within an internal circumferential groove in a wellhead. After the toroidal member is manufactured with the predetermined cross-sectional shape, it is cut into at least three segments. In one embodiment, two spaced apart holes are first drilled and then tapped to provide internally threaded holes. The axes of the tapped holes are parallel to the toroidal member toroidal axis. After the holes are drilled and threaded, the integral toroidal member is cut into at least three segments. Cuts are made in the toroidal member through each of the tapped holes, the first two cuts being in planes that are parallel to each other to provide a first segment having end surfaces that are in planes parallel to each other. This first segment is a "key" segment, the importance of which will be described subsequently. The tapped holes are drilled at locations in the toroidal member that are spaced apart a distance less than the diameter of the toroidal member and at a distance apart from each other that is preferably about equal to the radius of the toroidal member. Therefore, after cuts are made in the toroidal member through the drilled and tapped holes, the toroidal member is then in two pieces, one piece being the portion of the toroidal member between the tapped holes which is a circumferential portion substantially less than one-half of the circumference of the toroidal member. The remainder is greater then a semi-circular portion of the toroidal member and it is cut into two, preferably about equal length portions, so that the toroidal member is now in three segments.

The segmented load shoulder can then be installed in a circumferential groove in a passageway by manually installing the two larger segments of the toroidal member (referred to as first and second segments) followed by insertion of the third or "key" segment—that is, the segment between the spaced apart tapped holes. After the three segments are in position, a set screw is threaded into each of the tapped holes. This is one way of retaining the segments in position in the groove. In addition, to preserve the original internal and external diameter of the toroidal member, a spacer can be positioned between adjacent ends of the first and second segments, the spacer being preferably about the width of the saw blade employed to cut the segments. The spacer can be in the form of a spacer button. In this case, a short depth drilled opening is provided in one end surface of the first segment. A cylindrical portion of a spacer button is slidably inserted into the drilled opening. The spacer button has a head portion of a thickness equal to the thickness of the saw blade used to cut the toroidal member into segments.

The toroidal member as initially formed is configured to have an external circumferential surface that conforms to the shape of the groove provided in the cylindrical member, such as a wellhead and further, the toroidal member is preferably provided with a seating surface that is frustoconical in configuration as typically employed on load shoulders.

A complete understanding of the invention will be obtained from the following detailed description of the preferred embodiments taken in conjunction with the attached drawings.

DESCRIPTION OF THE DRAWINGS

FIG. 2 is a top plan view of a toroidal member forming the load shoulder of this invention and showing the toroidal member after it has been manufactured to have the predefined internal and external circumferential surfaces and showing the provision of two spaced apart drilled and tapped holes. Further, in FIG. 2 the toroidal member is shown after having been cut into three segments, two of the cuts taking place through the tapped holes.

FIG. 3 is a diagrammatic view of the two larger segments of the toroidal member in the process of being installed in an internal groove in a wellhead. When the installation of the load shoulder is complete the relationship of the components will be that as shown in FIG. 2.

FIG. 4 is an external cross-sectional view of an internal section of the wellhead of FIG. 1 with the load shoulder in position.

FIG. 5 is an elevational view of a small spacer button used to maintain proper spatial relationship between the segments of the installable load shoulder.

FIG. 6 is a fragmentary cross-sectional view of a wellhead showing the key segment of a load shoulder in a groove in a cylindrical passageway with a pin driven through an opening in the key segment to hold it in place, and thereby to lock the entire load shoulder in the groove.

FIG. 7 is a fragmentary cross-sectional view like FIG. 6 but showing the use of a bolt for holding the key segment in the groove.

DETAILED DESCRIPTION OF A PREFERRED EMBODIMENT

Figure 1:
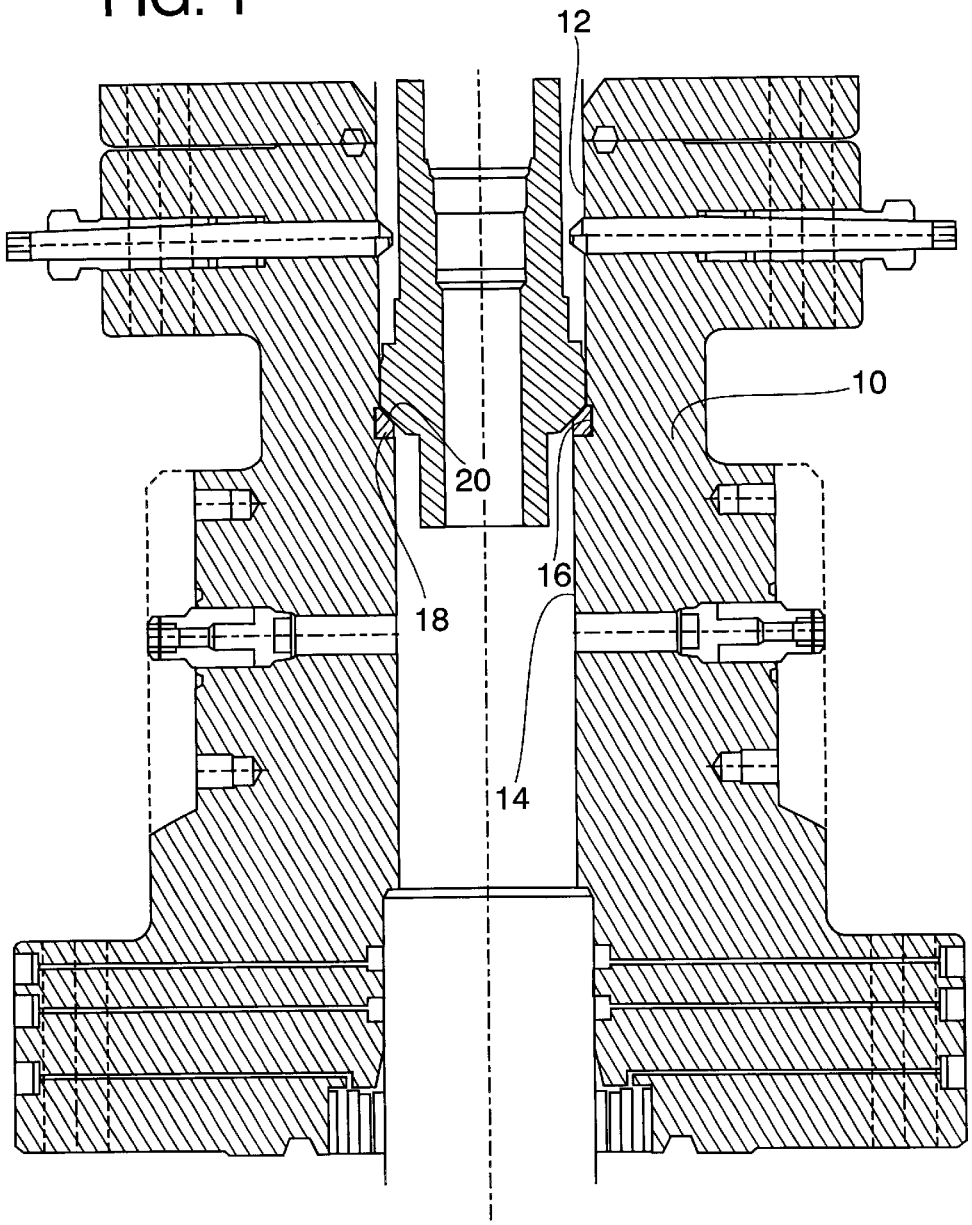
FIG. 1 is an elevational cross-sectional view of a wellhead showing an environment in which the installable load shoulder of this invention is employed.

FIG. 1 illustrates an internal circumferential shoulder in a cylindrical passageway as employed by way of example, as a load shoulder in a wellhead. A wellhead, indicated by the numeral 10 has a vertical passageway therethrough. An upper enlarged internal diameter portion of the passageway is indicated by the numeral 12 and a lower, reduced internal diameter portion by the numeral 14. At the transition between upper and lower passageways portions 12 and 14 is a circumferential groove 16 in which is positioned, as illustrated in cross-section, a load shoulder 18. This invention is concerned with the configuration of load shoulder 18 as well as the method by which it is manufactured and installed.

Most wellheads in use today provide a load shoulder surface that is integrally formed as the wellhead is manufactured. That is, typically the wellhead 10 is a casting of metal, usually steel, with the upper and lower passageway portions 12 and 14 machined within the interior of the casting, the machining providing a frusto-conical shoulder surface 20. When the shoulder surface 20 is integrally formed of the material of which wellhead itself is formed the area of surface contact required to support the enormous weight of a suspended string of casing or tubing is such that the difference between the interior diameter of the passageway lower portion 14 compared with the upper portion 12 must be significant. Stated another way, the structural requirements of a wellhead designed for a deep well application and having an integral load shoulder mandates a significant reduction in the internal diameter of passageway lower portion 14.

This invention is intended to provide an installable load shoulder that can be made of high strength material, such as high strength metal alloy to thereby reduce the required total area of the conical shoulder surface 20 of the load shoulder so as to thereby enable the wellhead to be designed with a reduced differential between internal diameters 12 and 14. The improved load shoulder is illustrated in FIGS. 2–4. The installable segmented load shoulder as indicated generally by the numeral 22 is, as previously indicated, preferably made of a high strength metal alloy and machined into an integral toroid with a cross-sectional shape as shown in the left hand portion of FIG. 4. As machined, the integral toroid has an exterior circumferential surface 24, an interior circumferential surface 26, a bottom planar toroidal surface 28, a top planer toroidal surface 30 and a frusto-conical load surface 32.

After a toroid having surfaces 24–32 has been machined, a first hole 34 and a spaced apart second hole 36 are drilled into frusto-conical load surface 32. The axis 38 of hole 34, as seen in FIG. 4, is parallel to the toroidal axis 40 of load shoulder 22. In the same way, the axis (not seen) of second hole 36 is parallel to toroidal axis 40. After holes 34 and 36 are drilled, they are internally tapped that is, provided with internal threads. Holes 34 and 36 are drilled downwardly through frusto-conical load surface 32 that is, interiorly of the top planar toroidal surface 30.

After drilling and threading tapped holes 34 and 36, the toroidal load shoulder 22 is cut into three segments. A first cut 42 is made through hole 34 and a second cut 44 is made through hole 36. Cut 42 is made in a plane 46 that, if extended, would define a segment of the toroidal member external surface 24. In like manner, cut 44 through second hole 36 is made in a plane 48 that would define a segment of the toroidal member external circumferential surface 24. Planes 48 and 46 are spaced apart from and parallel to each other.

A third cut 50 is made through the toroidal member and preferably but not necessarily, in a plane 52 that is midway between and parallel to planes 46 and 48. After third cut 50 the toroidal member is in three segments that is, a first segment 54, a second segment 56 and a third segment 58.

After the three segments are formed by cutting the toroidal member, a short depth hole 60 is drilled into an end face 62 of first segment 54. A spacer button 64, as seen in FIG. 5, has a cylindrical portion 66 and an integral flat head portion 68. The cylindrical portion 66 is positioned in hole 60 so that the head portion 68 remains exterior of end face 62.

While the installable segmented load shoulder 22 can be installed in the field, it is preferably installed as a step in the manufacture of a wellhead 10, that is, installed in the shop where wellhead 10 is made. As shown in FIG. 3, the load shoulder is installed by inserting first segment 54 into groove 16 formed in the interior passageway of wellhead 10. Note that the spacer button 64 is in place with the head portion 68 exterior of the first segment end face 62. Next, second segment 56 is positioned within circumferential groove 16 in the wellhead. The second segment 56 has an end surface 70 that is formed when third cut 50 is made in the integral toroidal member. Second segment 56 is installed in wellhead groove 16 so that end surface 70 is contiguous to spacer button head portion 68. The function of spacer button 64 is to provide a head portion 68 that is of a thickness substantially equal to saw cut 50 that was made to separate first and second segments 54 and 56.

With the first and second segments 54 and 56 received within groove 16, third segment 58 is then slidably positioned into groove 16. When in position the assembled segments of the load shoulder have relationship with each other as shown in FIG. 2. Set screws 74 and 76 are then threadably positioned in threaded and tapped first and second holes 34 and 36. Set screws 74 and 76 are of the type having a recessed hexagonal socket so that the upper end of each set screw is spaced below frusto-conical load surface 32. The set screws when threaded into tapped holes 34 and 36 hold the segments spaced from each other the distance of saw cuts 42 and 44 so that the segmented load shoulder when in position with the set screws in place has an external diameter of circumferential surface 24, the same as the toroidal member had before the first, second and third cuts are formed. This insures that the segmented toroidal load shoulder is held securely and firmly in position within circumferential groove 16.

The configuration of circumferential groove 16 formed in the wellhead is such as to provide a toroidal support surface 72 (See FIG. 4) having a depth D providing a relatively large bearing area for support of the load shoulder. The design of the segmented load shoulder which permits the segments to be radially inserted into a circumferential groove 16 permits a load shoulder having a depth D that is sufficient to provide a bearing area to support the enormous loads of strings of tubing or casing.

By constructing load shoulder 22 of high strength metal and having a wide bearing area bottom surface 28 that rests on the wellhead bearing surface 72, an engineer can design the wellhead to have a passageway lower portion 14 of larger internal diameter than a wellhead having an integrally formed load shoulder. This means that a larger diameter piece of equipment, such as a bit, or larger diameter tubing or casing as the case may be, may be passed through the wellhead.

FIG. 6 shows a slightly alternate embodiment of the invention compared to the cross-sectional view of FIG. 4. Whereas FIG. 4 discloses the use of a set screw 74, FIG. 6 shows an installable segmented load shoulder at third section 58 having a vertically drilled hole 78 that extends from the segment frusto-conical load bearing surface 32 through the bottom surface 28. Hole 78 is coincidental with an opening 80 drilled in wellhead 10. After the segments of the installable load shoulder are positioned within groove 16 in the wellhead, the final or "key" segment is installed. To retain the key segment 58 in position at least one vertical hole 78 is drilled through the load shoulder segment and this drill passageway matches drilled opening 80 in the wellhead itself. A pin 82 is then driven through opening 78 and into opening 80 to hold the key segment 58 in position. More than one spaced-apart pin may be employed to retain the key segment in position. After installation, the key segment functions to retain the other segments of the installable load shoulder within groove 16.

The use of the system of FIG. 6 obviates the need for drilling and tapping holes 34 and 36 in the load shoulder as have been described with reference to FIG. 2.

A unique feature of the invention is that of providing an installable load shoulder having a key segment and means for retaining the key segment in position within the wellhead or other tubular member in which the load shoulder is employed. FIG. 6 illustrates one way of securing the key segment in position. FIG. 7 is an illustration of another system for retaining the key segment in position. In FIG. 7, load shoulder key segment 58 is provided with a horizontally drilled hole 84 that has an enlarged diameter portion 84A at the load shoulder interior surface 26. Coincident with horizontal drilled hole 84 is a drilled and tapped hole 86 in wellhead 10 or other tubular member in which the shoulder is installed. Threadibly positioned within drill hole 84 and drilled and tapped hole 86 is a bolt 88 having a head, the bolt being threaded into position to retain a key segment 58 within groove 16.

It can be easily observed that the three methods employed for retaining key segment 58 in position are illustrative of the invention that provides an installable segmented load shoulder and in which a key segment is employed to retain all elements of the load shoulder in position within a groove in a cylindrical passageway.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of manufacturing an installable segmented shoulder for use in a body having a cylindrical opening therein, the cylindrical opening having an enlarged internal diameter circumferential groove providing an internal circumferential cylindrical wall surface and an upwardly facing circumferential bottom support surface, comprising the steps of:

(a) machining an integral unitary toroidal shoulder blank having an external cylindrical wall surface substantially equal to said body circumferential groove wall surface and a toroidal bottom support surface substantially matching said body groove bottom support surface;

(b) drilling a plurality of holes through said shoulder blank, each said hole having an axis parallel to a toroidal axis of said shoulder blank; and (c) cutting said shoulder blank into a plurality of at least three segments, at least one cut through one of said holes drilled, each segment having opposed end surfaces that match the end surfaces of adjacent segments, the opposed end surfaces of at least one segment being defined by paralleled spaced apart planes.

2. A method of manufacturing an installable segmented shoulder according to claim 1 including, after step (a) and after said step of drilling a plurality of holes through said shoulder of, internally threading at least one drilled hole before a cut is made therethrough.

3. A method of manufacturing a segmented shoulder according to claim 1 wherein step (a) includes machining a frusto-conical load bearing surface on said unitary toroidal shoulder blank.

4. A method of manufacturing an installable segmented shoulder according to claim 3 where each said hole drilled through said shoulder blank is drilled through said frusto-conical load bearing surface.

5. A method of manufacturing a wellhead comprising:

(a) making a metal wellhead structure;

(b) completing a first vertical passageway of a first internal diameter through said wellhead structure;

(c) completing an enlarged internal diameter upper portion of said vertical passageway;

(d) forming an enlarged internal diameter circumferential groove in said wellhead structure at a transition between said internal diameters, the groove providing an internal circumferential cylindrical wall surface and an upwardly facing circumferential bottom support surface;

(e) machining an integral unitary load shoulder blank having an external cylindrical wall surface substantially equal to said wellhead circumferential groove wall surface and a circumferential bottom support surface substantially matching said wellhead groove upwardly facing circumferential bottom support surface and having a circumferential frusto-conical load bearing surface;

(f) cutting said load shoulder blank into a plurality of at least three segments, each segment having opposed end surfaces that match the end surfaces of adjacent segments, the opposed end surfaces of one segment being defined by parallel, spaced apart planes forming a key segment;

(g) installing at least one spacer between a pair of adjacent segment end surfaces, said spacer in the same circumferential path as said segments; and (h) positioning said load shoulder segments into said load shoulder groove in said wellhead structure, said key segment having paralleled end surfaces being inserted last to thereby provide a circumferential load bearing frusto-conical surface within said wellhead structure.

6. A method of manufacturing a wellhead according to claim 5 wherein at least one end surface spacer is externally threaded.

7. A method of manufacturing a wellhead according to claim 5 wherein at least one end surface of at least one segment has a recess therein and wherein said spacer is in the form of a button member having a cylindrical shaft portion and a head portion, the shaft portion being receivable in said recess and said head portion serving to provide spacer function.

8. A method of manufacturing a wellhead according to claim 5 wherein, after step (e) and before step (f) of drilling at least one hole through said load shoulder blank through said load shoulder frusto-conical surface, each hole having an axis parallel to a toroidal axis of said unitary load shoulder blank, and wherein the step of cutting said shoulder blank into a plurality of segments includes cutting through said openings drilled in said shoulder blank.

9. A method of manufacturing a wellhead according to claim 8 including after said step of drilling at least one hole through said load shoulder of internally threading at least one drilled hole before a cut is made therethrough.

10. A method of manufacturing a wellhead according to claim 5 including the step of:

(i) securing said key segment within said groove to thereby retain all of said segments within said groove.

11. A method of manufacturing a wellhead according to claim 10 wherein step (i) of securing said key segment within said groove includes the insertion of retainer members between opposed end surfaces of said key segment and end surfaces of adjacent segments.

12. A method of manufacturing a wellhead according to claim 10 wherein step (h) of securing said key segment within said grooves includes attaching said key segment to said wellhead structure.

13. A method of manufacturing a wellhead according to claim 10 includes threading a bolt through an opening in said key segment and into a threaded opening in said groove circumferential cylindrical wall surface.

* * * * *